US011414165B2

(12) United States Patent
Osienski et al.

(10) Patent No.: US 11,414,165 B2
(45) Date of Patent: Aug. 16, 2022

(54) COMPLIANT NET SUPPORT SYSTEM FOR MARINE BARRIERS

(71) Applicant: HALO Maritime Defense Systems, Inc., Newton, NH (US)

(72) Inventors: Michael J. Osienski, Londonderry, NH (US); Eric G. Johnson, Danvers, MA (US); Judson DeCew, East Kingston, NH (US); Tom Sherwin, Newton, NH (US)

(73) Assignee: HALO Maritime Defense Systems, Inc., Newton, NH (US)

( * ) Notice: Subject to any disclaimer, the term of this patent is extended or adjusted under 35 U.S.C. 154(b) by 39 days.

(21) Appl. No.: 17/075,315

(22) Filed: Oct. 20, 2020

(65) Prior Publication Data

US 2021/0114700 A1 Apr. 22, 2021

Related U.S. Application Data

(60) Provisional application No. 62/923,679, filed on Oct. 21, 2019.

(51) Int. Cl.

| | |
|---|---|
| ***F41H 11/05*** | (2006.01) |
| ***B63G 9/04*** | (2006.01) |
| *E01F 13/12* | (2006.01) |

(52) U.S. Cl.

CPC ..... *B63G 9/04* (2013.01); *F41H 11/05* (2013.01); *E01F 13/12* (2013.01)

(58) Field of Classification Search

CPC ..... B63G 9/04; F41H 11/05

See application file for complete search history.

(56) References Cited

U.S. PATENT DOCUMENTS

| | | | |
|---|---|---|---|
| 2,693,161 | A | 11/1954 | Stubbs |
| 3,185,445 | A | 5/1965 | Broadway |
| 3,499,291 | A | 3/1970 | Mikkelsen |
| 3,604,389 | A | 9/1971 | Roberts et al. |

(Continued)

FOREIGN PATENT DOCUMENTS

WO WO-2012058149 A1 * 5/2012 ..... B63G 9/04

OTHER PUBLICATIONS

International Search Report and Written Opinion of the International Searching Authority dated Sep. 23, 2021 in PCT/US2021/037873.

*Primary Examiner* — Andrew Polay

(74) *Attorney, Agent, or Firm* — Studebaker & Brackett PC

(57) ABSTRACT

A compliant net support system for supporting a net of a marine barrier is provided. Embodiments include a floating marine barrier module comprising a flotation device; a supporting framework attached to the flotation device; a plurality of impact net support posts; and an impact net attached to each of the support posts and extending between the plurality of support posts along a longitudinal axis of the barrier module. At least one of the impact net support posts is a compliant net support post having a unidirectionally elastic spring element attached between a bottom of the support post and the supporting framework; and the spring element is movable in a direction substantially parallel to the longitudinal axis of the barrier module, and substantially inflexible in a direction substantially perpendicular to the longitudinal axis of the barrier module.

20 Claims, 19 Drawing Sheets

(56) References Cited

U.S. PATENT DOCUMENTS

| | | | | |
|---|---|---|---|---|
| 4,319,858 | A | 3/1982 | Jaffrennou et al. | |
| 5,062,739 | A | 11/1991 | Klockner | |
| 5,141,359 | A | 8/1992 | Klockner | |
| 5,179,907 | A | 1/1993 | Galbraith | |
| 5,980,159 | A | 11/1999 | Kazim | |
| 6,591,774 | B2 | 7/2003 | Metherell et al. | |
| 6,655,641 | B2 | 12/2003 | Sherman et al. | |
| 6,681,709 | B1 | 1/2004 | Nixon et al. | |
| 6,843,197 | B1 | 1/2005 | Nixon et al. | |
| 6,877,456 | B2 | 4/2005 | Metherell et al. | |
| 6,960,047 | B2 | 11/2005 | Knezek et al. | |
| 6,980,483 | B2 | 12/2005 | McDonald | |
| 7,140,599 | B1 * | 11/2006 | Spink | E02B 15/085 405/71 |
| 7,401,565 | B2 | 7/2008 | Nixon et al. | |
| RE40,616 | E | 1/2009 | Nixon et al. | |
| 9,683,342 | B2 | 6/2017 | Bishop | |
| 2004/0018060 | A1 | 1/2004 | Knezek et al. | |
| 2004/0115002 | A1 | 6/2004 | Meeks et al. | |
| 2005/0013668 | A1 * | 1/2005 | Nixon | E02B 15/085 405/218 |
| 2005/0058509 | A1 | 3/2005 | Steinberg | |
| 2005/0191129 | A1 | 9/2005 | Yodock et al. | |
| 2006/0034668 | A1 | 2/2006 | Knezek et al. | |
| 2006/0037526 | A1 | 2/2006 | Knezek et al. | |
| 2006/0045618 | A1 * | 3/2006 | Bibber | E01F 13/12 404/6 |
| 2006/0140718 | A1 * | 6/2006 | Lamore | E01F 13/12 404/6 |
| 2006/0216116 | A1 | 9/2006 | Baker et al. | |
| 2007/0102689 | A1 | 5/2007 | Alberson et al. | |
| 2007/0140791 | A1 * | 6/2007 | Gelfand | E01F 13/12 404/6 |
| 2008/0105184 | A1 | 5/2008 | Nixon et al. | |
| 2009/0035068 | A1 | 2/2009 | Terai et al. | |
| 2012/0121342 | A1 | 5/2012 | Utz et al. | |
| 2019/0137225 | A1 | 5/2019 | Terai et al. | |
| 2020/0116458 | A1 | 4/2020 | Knezek et al. | |
| 2021/0114700 | A1 | 4/2021 | Osienski et al. | |

* cited by examiner

COMPLIANT NET SUPPORT SYSTEM FOR MARINE BARRIERS

FIELD

The present subject matter relates to marine barriers and movable gates. More particularly, the present disclosure relates to floating barrier systems, and to providing compliance and increased service life to capture net systems utilized in new and existing port security barriers and gates.

BACKGROUND

The disclosed embodiments improve upon conventional marine barriers and the methods for securing capture net systems used on such barriers. Most marine barriers utilize one or more capture nets (i.e., impact nets) to engage and impede a threat vessel's motion within a restricted water space. The conventional method of securing the capture net to the marine barrier typically employs bolting or otherwise connecting the net to a rigid beam (a post, beam, etc.) that is secured to the main structural elements of the floating barrier system. This rigid attachment method creates a stress/load concentration in the netting in places where the barrier motion is resolved (i.e., at connection points between barrier segments).

Compliant versus Rigid Capture Net Connections

In traditional marine barriers 1510 such as shown in FIG. 15, the capture net system (i.e., the impact net 1514) is typically secured to vertical posts or beams 1512 that are rigidly mounted to the main structural elements 1516 and cannot move relative to the base floatation structure 1518. See, for example, the marine barriers described in U.S. Pat. No. 6,681,709. This method works well for net attachment over a single continuous barrier module. However, the net can experience significant loads and stress concentrations at connection points between floating barrier segments as the net must span these joints. As the floating barriers segments move out of phase (for example, due to wave events), the net is loaded with "snap" type forces which decrease the service life of the component.

Barrier segments are typically fabricated in set lengths (15 ft., 40 ft., etc.). The connection between the modules is performed via a variety of methods; for example, being tethered via rope or chain, connected via a reinforced compliant elastomer (such as a rubber joint) or connected via a mechanical joint (such as a pin or "door hinge" type connection). The capture net is typically connected to a rigid post near or adjacent to these joints. Because a significant proportion of barrier motion is resolved at these jointed locations, the net is subjected to high loads (snap loads) in extreme wave events. This significantly reduces the service life of the capture net and creates a "weak link" in the barrier security system.

SUMMARY OF THE DISCLOSURE

An alternative to the foregoing disadvantageous scenario is to incorporate a compliant net support system that alleviates the stress in the net attachment points, yet retains the structural integrity of the system when subjected to extreme environmental or impact forces. A mounting post for the impact net that can flex and move will increase the service life of the component and decrease maintenance of the capture net and barrier system. In addition, this type of mounting can be used on a variety of different barrier systems, support spacings, and environments, providing a viable solution to the aforementioned problems.

The disclosed system improves upon the existing technology and can be utilized in a variety of configurations to resolve the significant cost of on-water maintenance operations.

Embodiments include a compliant net support system for supporting a net of a marine barrier. The compliant net support system comprises a plurality of substantially rigid columns, each of which is secured to the net and to a frame of the barrier, and a unidirectionally elastic spring element located along a main axis of at least one of the columns and disposed between the column and the barrier frame. The spring element and respective column is movable in a direction substantially parallel to a longitudinal axis of the barrier, and substantially inflexible in a direction substantially perpendicular to the longitudinal axis of the barrier.

Embodiments include a floating marine barrier comprising a plurality of barrier modules, each barrier module having a flotation device, a supporting framework attached to the flotation device, a plurality of impact net support posts, and an impact net attached to each of the support posts and extending between the plurality of barrier modules along a longitudinal axis of the barrier. At least one of the impact net support posts is a compliant net support post having a unidirectionally elastic spring element as a stress mitigation device attached between a bottom of the support post and the supporting framework. The spring element is movable in a direction substantially parallel to the longitudinal axis of the barrier, and substantially inflexible in a direction substantially perpendicular to the longitudinal axis of the barrier. Thus, when the barrier is floating in a body of water and a moving vessel impacts the impact net, the impact net deflects to transfer a force of the impact to the at least one of the compliant net support posts having the stress mitigation device and to one or more of the flotation devices, which in turn engage the water to transfer the force of the impact to the water to arrest the motion of the vessel, while the stress mitigation device remains substantially stationary relative to the at least one net support post.

In certain embodiments, the spring element comprises one or more leaf springs. In other embodiments, the spring element comprises coil spring(s) or a flexible rubber mount.

In other embodiments, one or more of the net support posts is compliant along substantially its entire length and provides the required flexibility. A floating marine barrier module according to these embodiments comprises a flotation device, a supporting framework attached to the flotation device, a plurality of impact net support posts, and an impact net attached to each of the support posts and extending between the plurality of support posts along a longitudinal axis of the barrier module. At least one of the impact net support posts is a compliant net support post which is flexible along substantially its entire length and attached to the supporting framework. The compliant net support post is flexible in a direction substantially parallel to the longitudinal axis of the barrier module, and substantially inflexible in a direction substantially perpendicular to the longitudinal axis of the barrier module. Accordingly, in such embodiments, substantially the entire net support post is a stress mitigation device, as opposed to only a select portion of the support post assembly.

The disclosed compliant net support system can be constructed using a variety of materials and configurations. One key system attribute is that the compliance of the net support system is primarily unidirectional to insure that the net will remain in the correct orientation and have the structural integrity required during an impact event (i.e., perpendicular loading), yet relieve stresses along the barrier length (i.e., loading parallel to the barrier length) due to environmental, motion, or translational forces.

Objects and advantages of embodiments of the disclosed subject matter will become apparent from the following description when considered in conjunction with the accompanying drawings. Additionally, the different configurations discussed in the sections below may be performed in a different order or simultaneously with each other.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Embodiments of the disclosure will now be described in detail with reference to FIGS. 1-14B, which illustrate various marine barriers and compliant net support systems that can be used for force protection of various assets.

Figure 1:
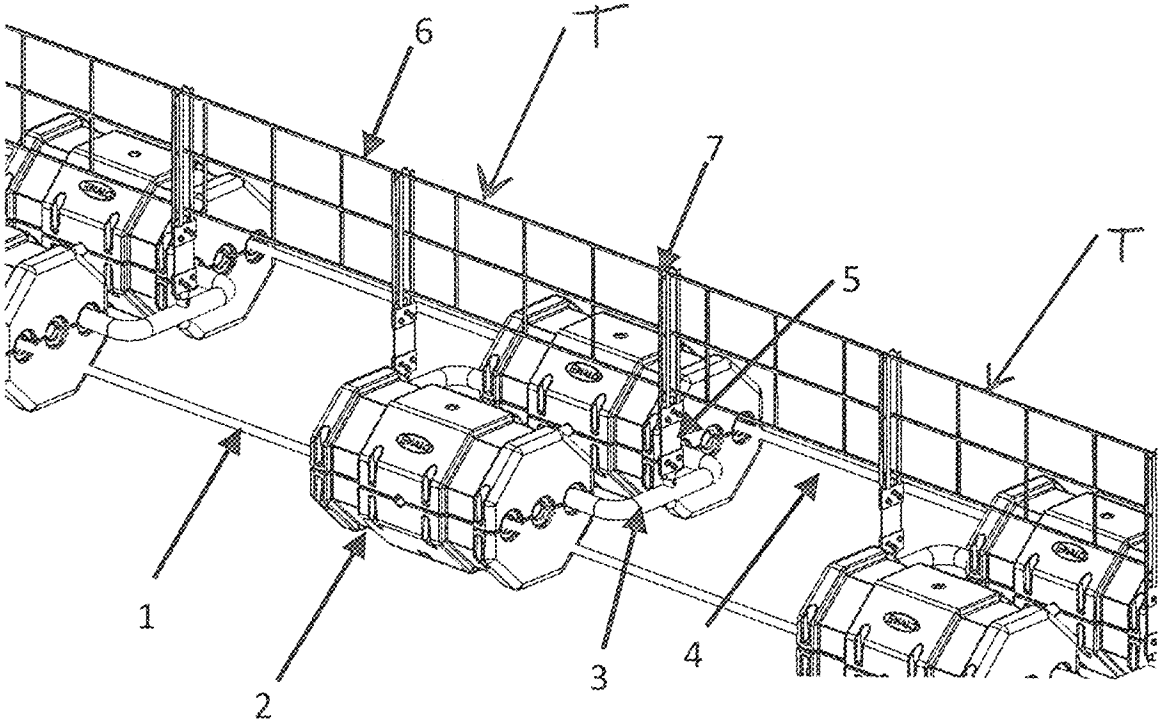
FIG. 1 schematically illustrates a marine barrier system with a compliant net support system according to the present disclosure.
Figure 2:
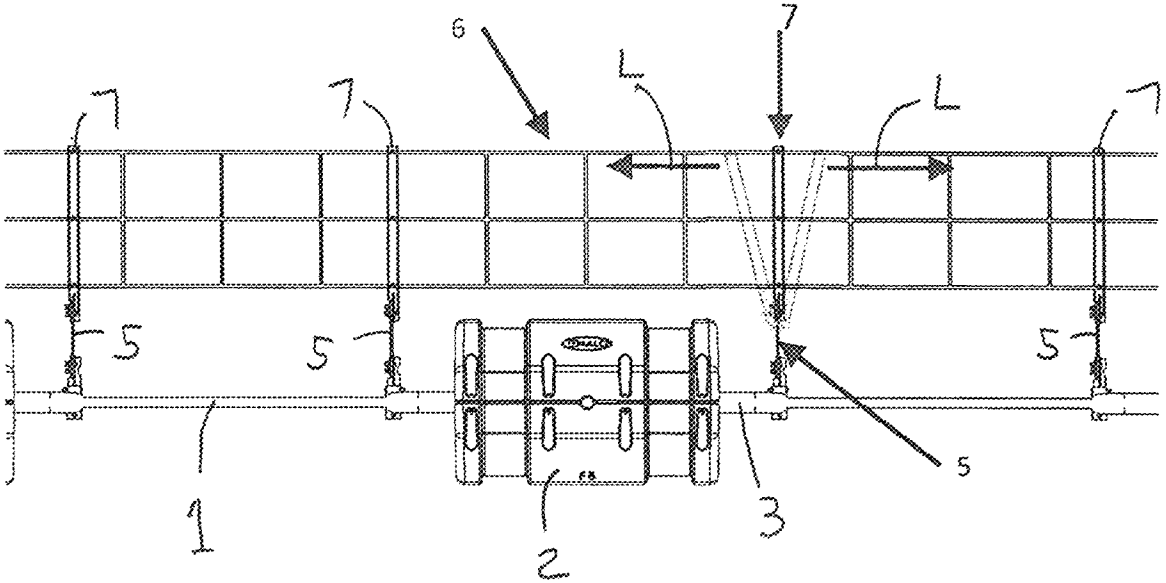
FIG. 2 schematically illustrates a side view of the marine barrier system of FIG. 1.

Referring now to FIGS. 1 and 2, a barrier system is shown comprising pairs of substantially parallel buoyant members such as flotation pontoons 2, connected via a framework 3. Barrier segments or "modules," each including two pontoons 2 and a supporting framework 3, are connected via tethers 1 and 4, which can comprise ropes, lines, cables, etc. The pontoons 2 can be made of a variety of materials (plastic, steel, composites) and provide primary system buoyancy. A capture net system incorporating a unidirectional compliant net support system is mounted on the supporting framework 3, and comprises an impact net 6 and impact net support beams 7.

The capture net system is mounted to each barrier module framework 3 via a unidirectional spring-type compliant net support post or beam 7. More particularly, each impact net support beam 7 has a stress mitigation device, such as a leaf spring 5, attached between the bottom of support beam 7 and the supporting framework 3.

Due to the shape of the spring 5, the system provides compliance in the barrier longitudinal direction indicated by arrows L, and resists motion in the transverse direction perpendicular to arrows L (indicated by arrows T). Since a vessel impact to the net 6 will mainly be in the transverse direction shown by arrows T, this allows the barrier to retain structural integrity during an impact event. Thus, the net 6 will not disadvantageously bend or flex out of the way of an impacting vessel, but the springs 5 will alleviate loads passed longitudinally through the netting 6 (i.e., axial loads associated with environmental or impact forces).

In summary, the disclosed compliant net support system consists of a rigid (metal or composite) framework that is secured directly to the net and frame itself, as well as an elastic "spring" element located along the net support system main axis. The spring element is primarily unidirectional and sized to provide compliance along the barrier's longitudinal axis, as seen in FIG. 2, Thus, the compliant net support system can move to alleviate loads on the capture system along the barrier's longitudinal axis.

The "spring" portion of the compliant net post can be a discrete length of the assembly, as shown in FIGS. 1-11, or be integrated into the full length of the assembly, as seen in FIGS. 12A-14B and described herein below.

The use of a unidirectional spring-based net support system is unique in marine barriers due to the dual requirements of the system. The net posts must be able to deform in wave events and resolve motion along the barrier's length. Yet it also must retain is stiffness and strength when loaded in the transverse direction such that when impacted by a vessel, the net remains at its designed height above the water and will retain its structural integrity.

A reason a unidirectional spring works is that the barrier segments align into an arc or catenary when loaded, due to environmental forces. Therefore, the "angle" between each segment is small—thus it is basically a straight line over the short distance between the modules. Therefore, the loading will always be along the barrier axis (thus unidirectional).

The use of a unidirectional spring is important as the net support post stiffness in the transverse direction (perpendicular to the barrier) needs to be significantly higher than the longitudinal (parallel) direction in the event of an impact event. If the spring was omni-directional, a vessel impact could push the net post over, and not engage the vessel—allowing a threat to enter into restricted water space. By having a unidirectional system, the environmental forces can be mitigated while still withstanding the impact events.

Those of skill in the art will understand that the required spring rate of a compliant net support system is a function of the barrier or net height off the water, the spacing between the net support posts, and the environment for which the barrier is sized. For the systems described herein with reference to FIGS. 1-11, exemplary spring rates and deformation ranges for the various compliant net posts are presented in Table 1 below.

TABLE 1

Exemplary Spring Rates for the Disclosed Compliant Net Support Systems

| Spring Rate (N-m/deg) | Typical Deflection (degrees) | Max Deflection (degrees) | Barrier Net Height (m) | Barrier/ Module Spacing (m) | Significant Wave Environments (m) |
|---|---|---|---|---|---|
| 15-50 N-m/degree | 5-15 deg. | 45 deg. | 0 m-1.2 m | <3 m | 2-3 m |
| 50-200 N-m/degree | 5-15 deg. | 45 deg. | 1.21 m-3 m | <5 m | 2-3.5 m |

Table 1 provides two ranges of spring rates for the disclosed compliant net system, in units of Newton-meters per degree. The corresponding "Typical Deflection" column values in Table 1 are "normal" deflections the compliant net support system will experience in typical environmental conditions. The corresponding "Max Deflection" column of Table 1 is the designed maximum deformation the compliant net support system can deflect before damage may occur to one or more of the components. The corresponding "Barrier/Module Spacing" column is the distance between compliant net support systems over an area where motion will be resolved (i.e., typically over a barrier module joint). This span is not applicable within the length of a continuous barrier segment that does not need to resolve net forces, such as that shown in FIG. 6A. Rather, it is the spacing of the compliant net support posts wherever they may be needed. Finally, the corresponding "Significant Wave Environments" column is the range of significant wave heights associated with the local site. The size of these waves (and thus fluctuation of the water surface elevation) affects selection of the spring rates detailed in the leftmost column of the table.

When implementing the disclosed compliant net support system, the spring rate can be adjusted for site-specific environmental conditions. One technique is to have a plurality of springs having different spring rates available at the site (e.g., two or three different springs), and select the best springs for that particular site. The length, width and material of the spring can be adjusted to obtain a variety of spring rates as needed, depending upon the barrier geometry, compliance needed, and local environmental conditions.

Figure 3:
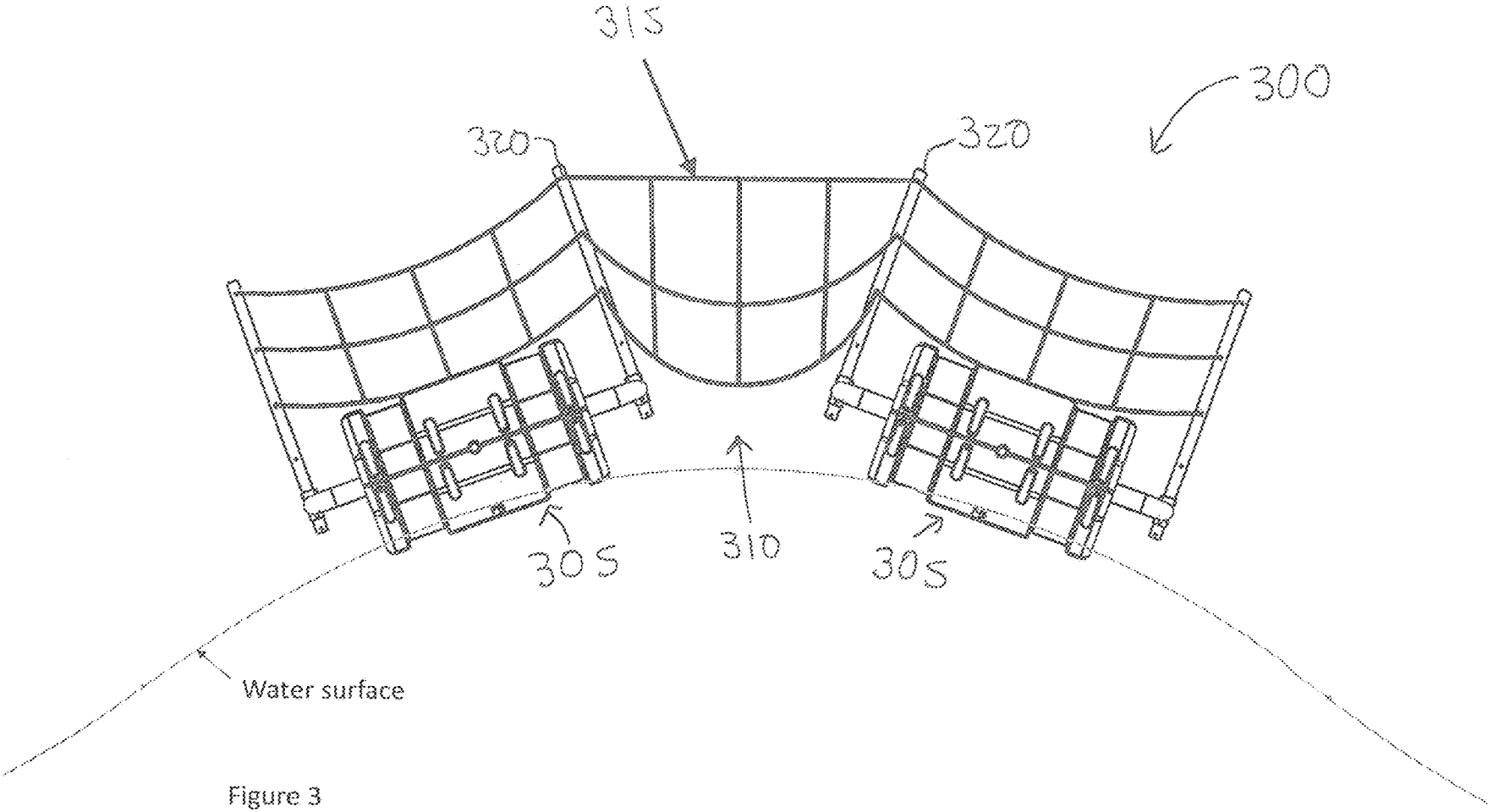
FIG. 3 schematically illustrates a side view of a marine barrier system having a conventional non-compliant net support system, and shows how such a typical net capture system is loaded in wave events without a compliant net support system.

The need for this type of solution is schematically illustrated in FIG. 3. When a barrier system 300 is subjected to waves, the joints 310 or locations along the barrier where individual modules 305 meet experience greater deformation and/or movement compared to the module 305 itself. Therefore, the impact net 315 is subjected to relative motion. In this situation, the net 315 will experience significant forces in the top or bottom sections of the net 315 depending upon whether the barrier 300 is on the crest or trough of the applied wave, respectively. This load is then transferred to the structural element supporting the net 315, such as net support post 320, and will result in increased net wear and net support post fatigue. The disclosed compliant net support system alleviates net stress in these situations by deformation of the spring element 5, as shown in FIG. 2.

Figure 4:
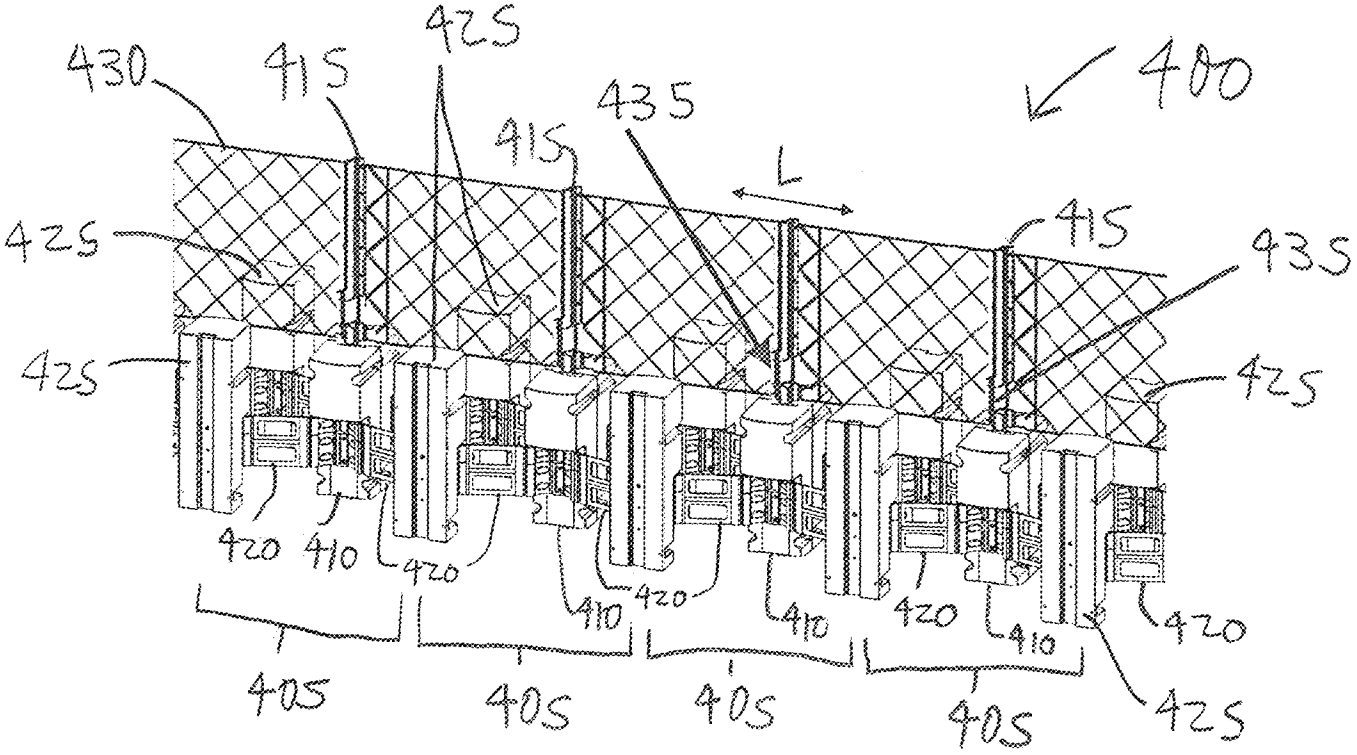
FIG. 4 is a perspective view of a marine barrier system including a compliant net support system according to the present disclosure.
Figure 5:
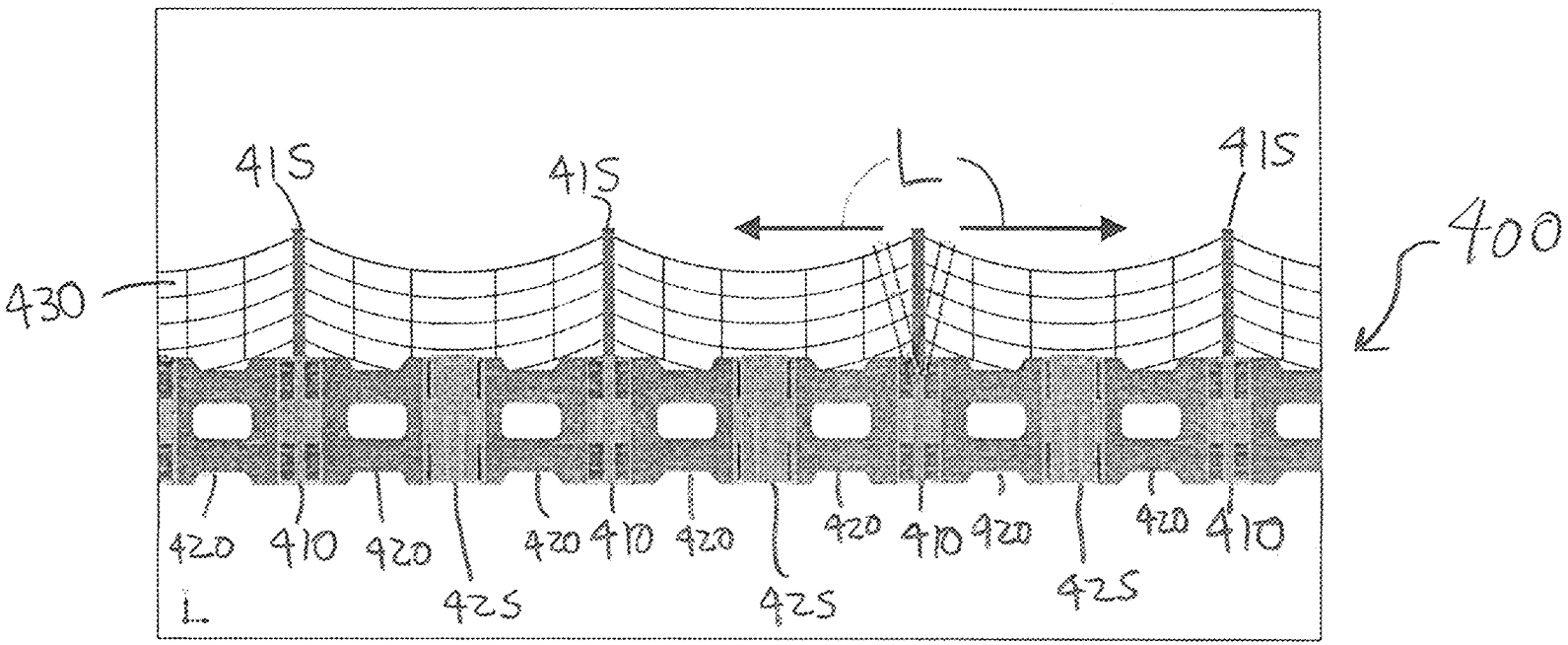
FIG. 5 is a side view of a marine barrier system including a compliant net support system according to the present disclosure.

FIGS. 4 and 5 depict the disclosed compliant net support system installed on a different barrier configuration, similar to that described in U.S. Pat. No. 9,683,342 entitled "Single Net Capture Marine Barrier System," which is hereby incorporated by reference in its entirety. Similar to the previously described barrier of FIGS. 1 and 2, the net support system of FIGS. 4 and 5 is unidirectional and provides compliance when the net is loaded due to environmental or impact forces.

The barrier system 400 of FIGS. 4 and 5 comprises a plurality of spaced-apart column modules 405, each having a buoyant central column 410 that carries an impact net support post 415. Each column 410 has four legs 420 extending from a lower portion of the column 410, and each leg 420 is connected to a buoyant float 425. Adjacent column modules 405 are thus connected to each other via the floats 425. A capture net system incorporating a unidirectional compliant net support system comprises an impact net 430, the impact net support posts 415, and a unidirectional leaf spring 435, attached between the bottoms of support posts 415 and the central columns 410. As shown in FIG. 5, the springs 435 allow the net support posts 415 to move in the longitudinal direction L of the barrier 400.

Figures 6A, 6B:
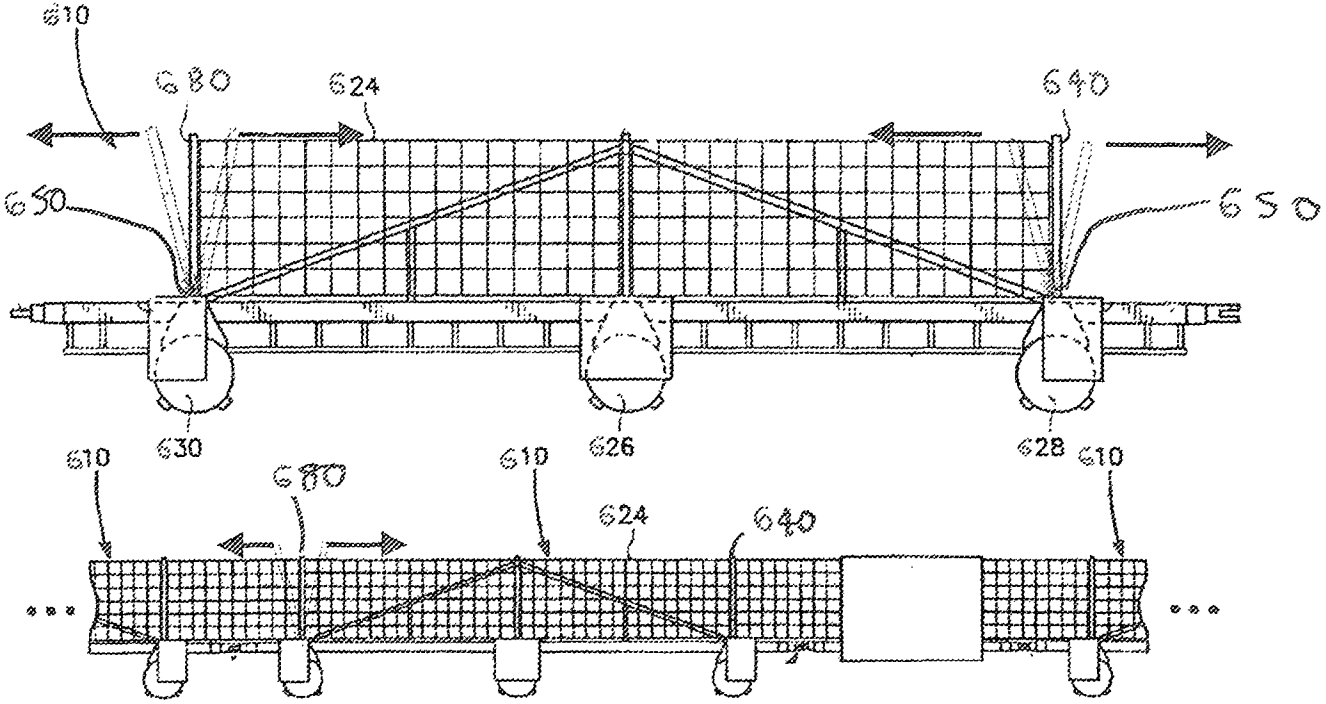
FIG. 6A is a side view of a marine barrier system including a compliant net support system according to the present disclosure.
FIG. 6B is a side view of a marine barrier system including a compliant net support system according to the present disclosure.

Further embodiments shown in FIGS. 6A-B include an existing marine barrier 610 similar to that described in U.S. Pat. No. 6,681,709, which is hereby incorporated by reference in its entirety, on which the disclosed compliant net support system is mounted. Its design can be significantly enhanced with the use of a compliant net support system integrated into the base design, wherein certain net support posts are replaced with compliant net support posts 640 and 680 in the figures. Unidirectional springs, such as leaf springs 650, are attached between the bottoms of support posts 640, 680 and the flotation devices 626, 628, 630. Note that item 652 in FIG. 6B is the joint between the barrier sections. The use of compliant net support posts 640, 680 resolves the net loads associated with the barrier motion, increasing the service life of the net 624 at joints 652.

Figure 7A:
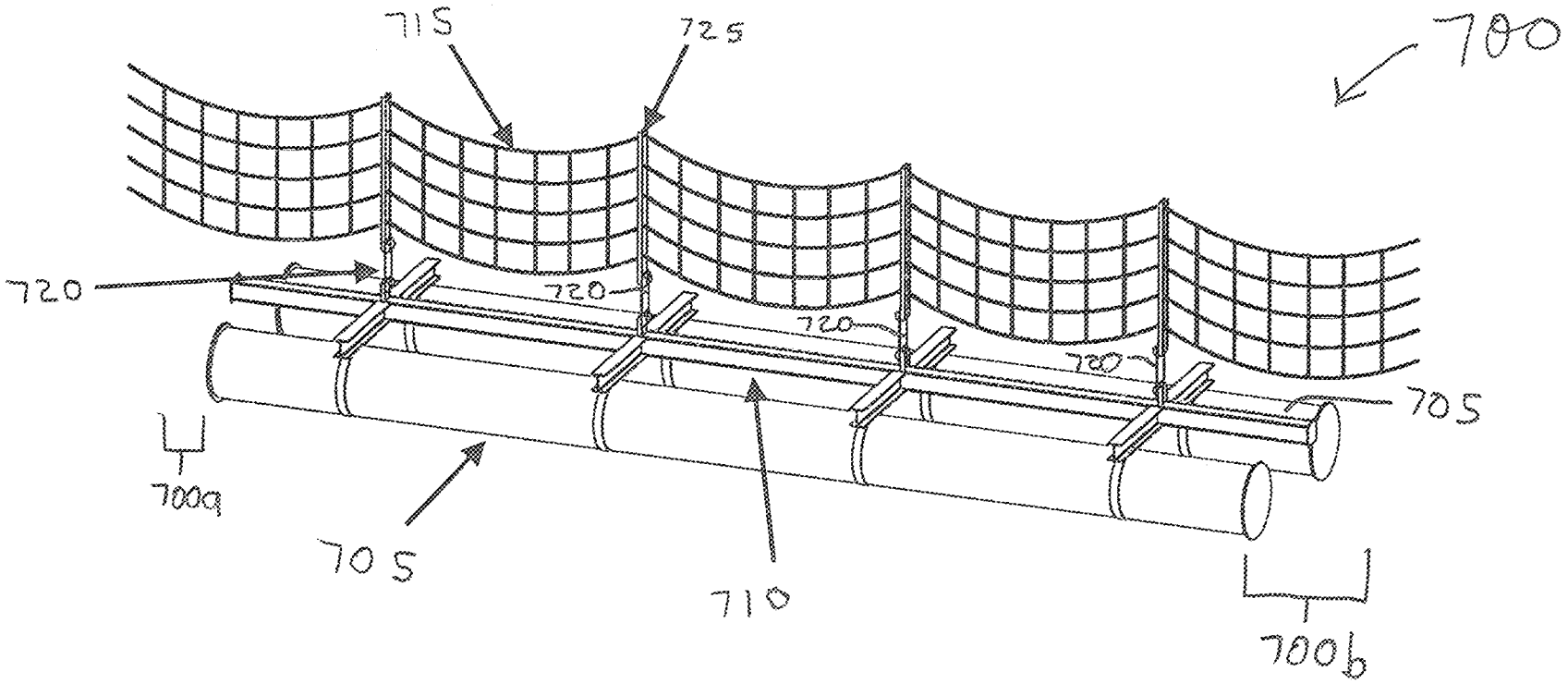
FIGS. 7A-7D show embodiments of the disclosed compliant net support system installed on conventional port security barrier.

FIGS. 7A, 7B, 7C and 7D schematically illustrate a generic conventional port security barrier with examples of different compliant net supports integrated into the design. The barrier is comprised of barrier segments or modules 700 having substantially parallel buoyant members 705 joined together via a framework 710. Due to the composite and/or steel beam construction of buoyant members 705 and framework 710, the barrier segment 700 is typically rigid along its length. Thus, the motion of the barrier segment 700 must get resolved at its end points 700*a*, 700*b*. Referring now to FIG. 7A, the disclosed compliant net support system includes a single leaf spring 720 attached to each net support post 725, to provide stress relief to the net 715 at the end points 700*a*, 700*b*. Those skilled in the art will understand that one or more of springs 720 can be used within a system.

Figure 7B:
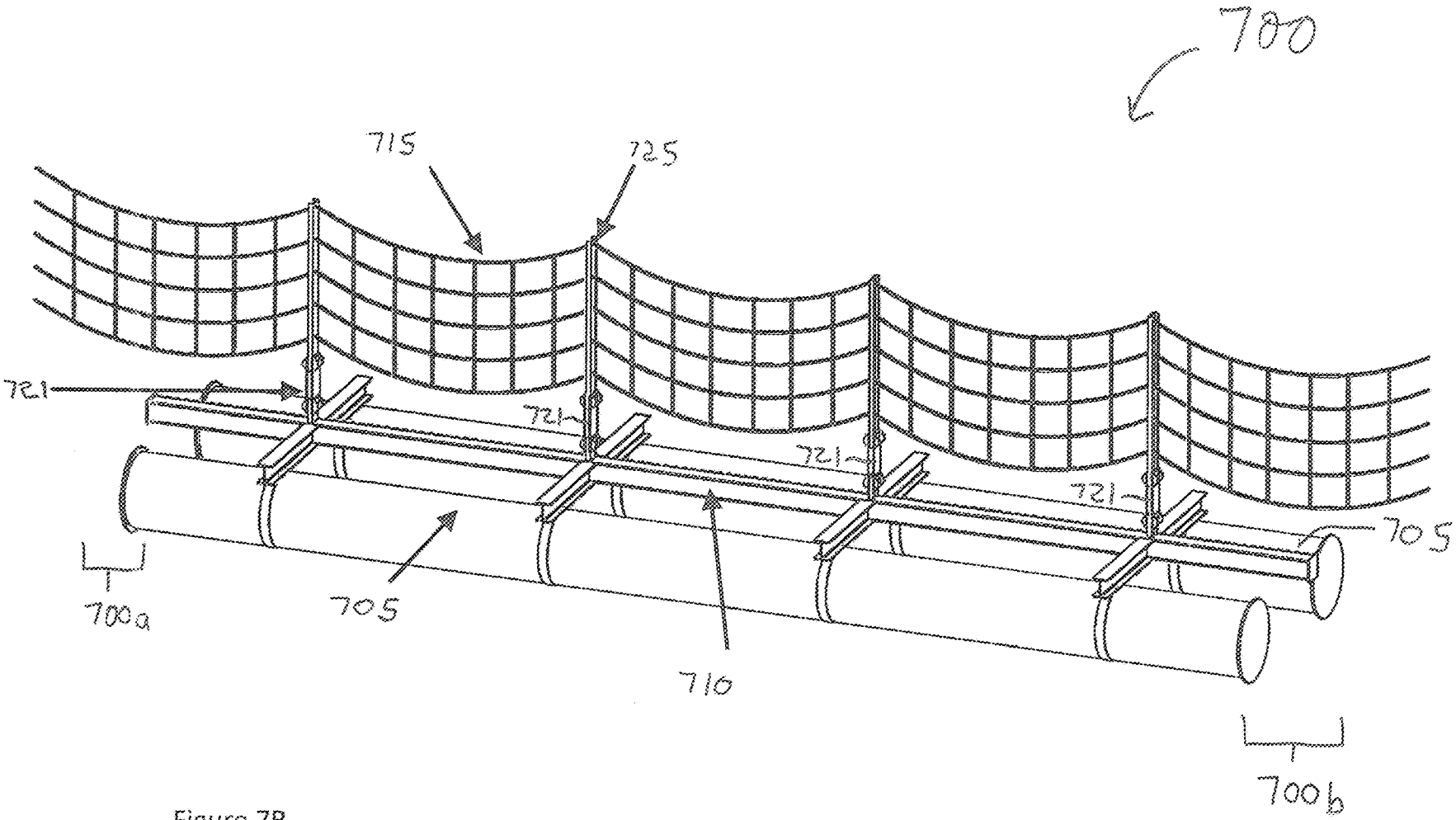
Figure 7C:
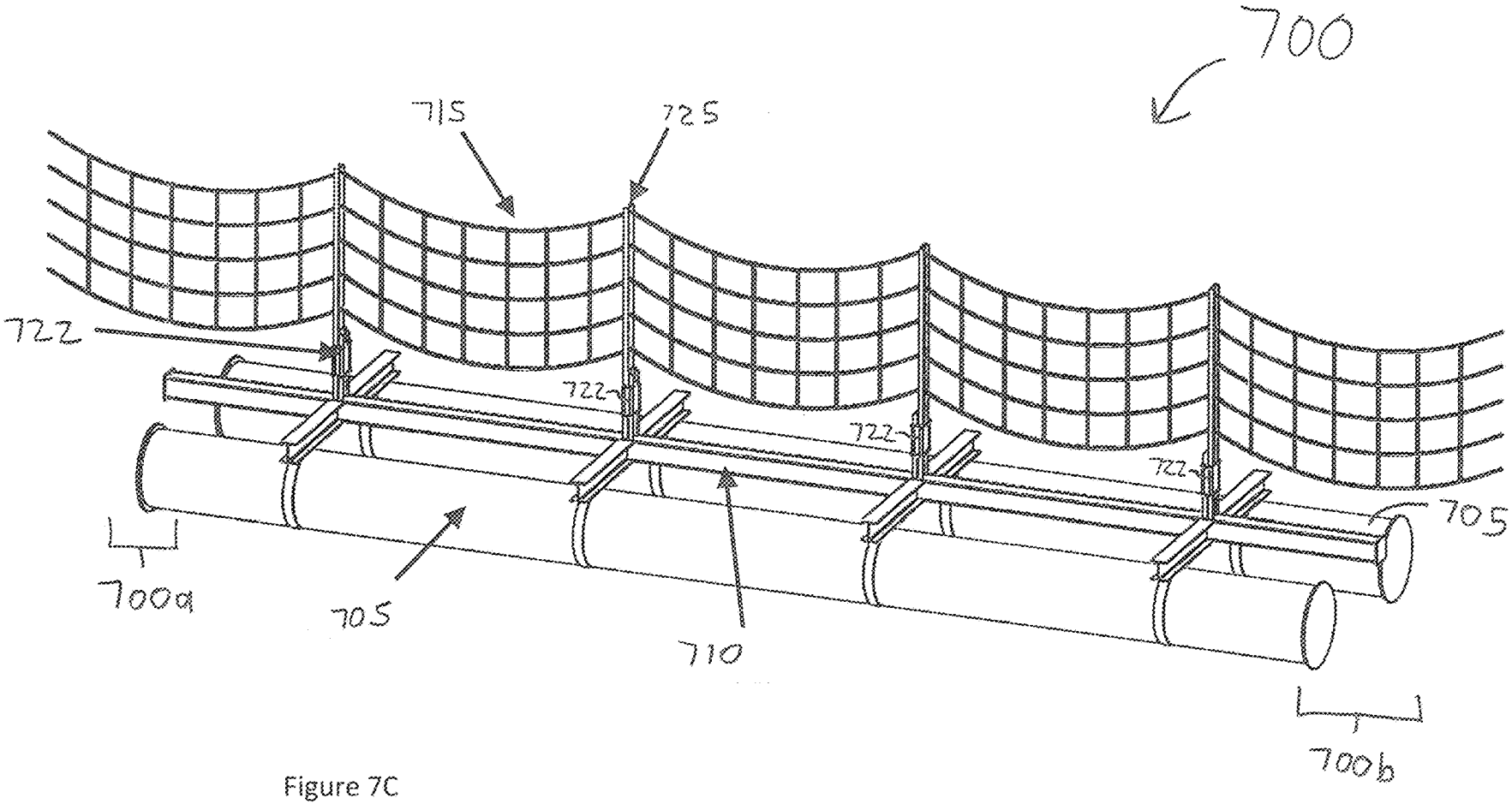
Figure 7D:
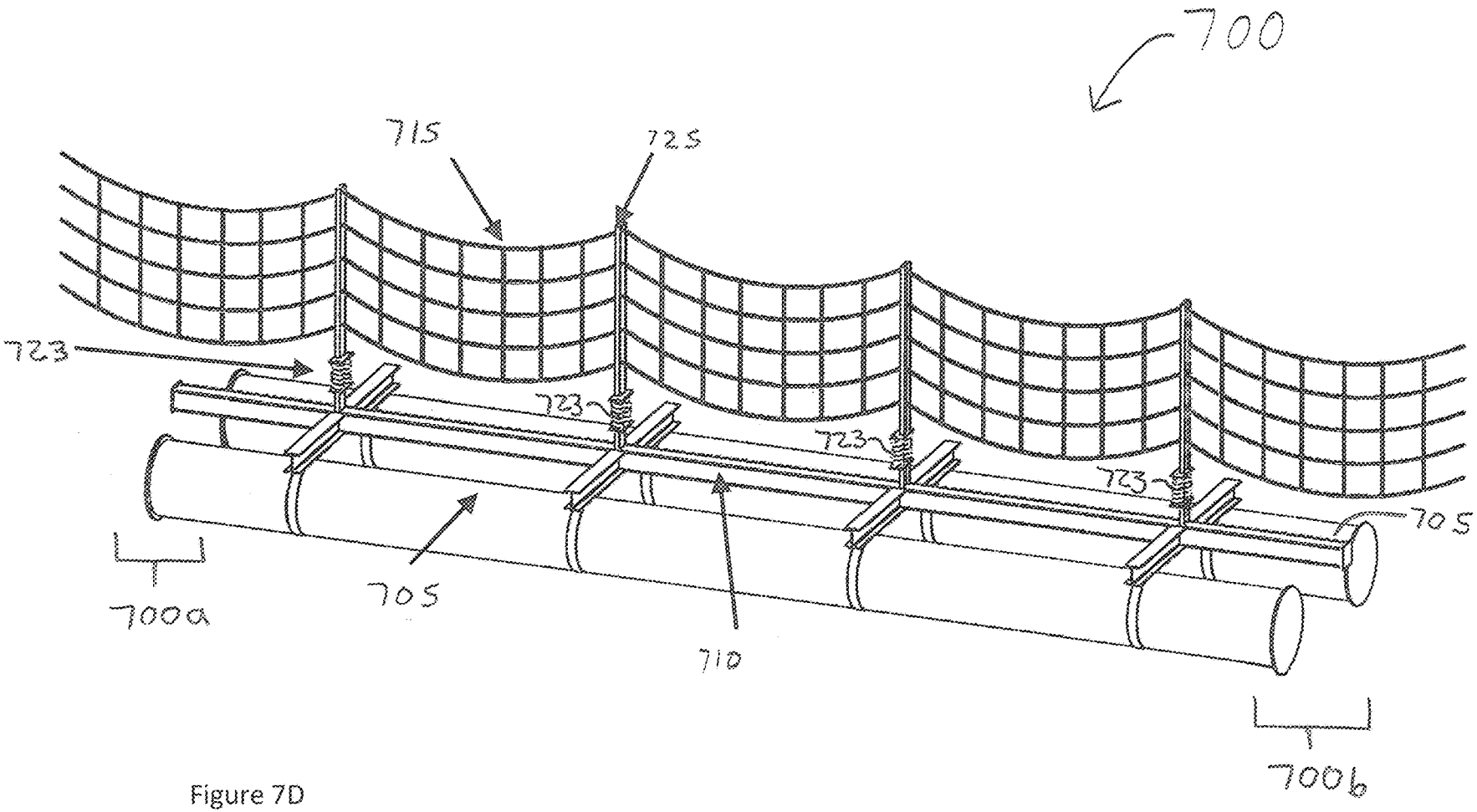

The barrier segments 700 of FIGS. 7B-D are identical to that of FIG. 7A, except the compliant net support system of FIG. 7B includes two leaf springs 721 attached to each support post 725; the compliant net support system of FIG. 7C includes a rubber spring 722 attached to each support post 725; and the compliant net support system of FIG. 7D includes coil springs 723 attached to each support post 725.

The spring mechanisms employed in the configurations shown in FIGS. 7A-7D are discussed in more detail in FIGS. 8-11. All spring net posts are, in general, firmly connected to the main structural or buoyant member on the end of the post (such as by welding, bolting, epoxy, etc.) and attached to the net at the other end. The compliant spring is located within that assembly and is sized according to the net height above the water, the barrier module spacing and the environment the barrier is deployed in.

Figure 8:
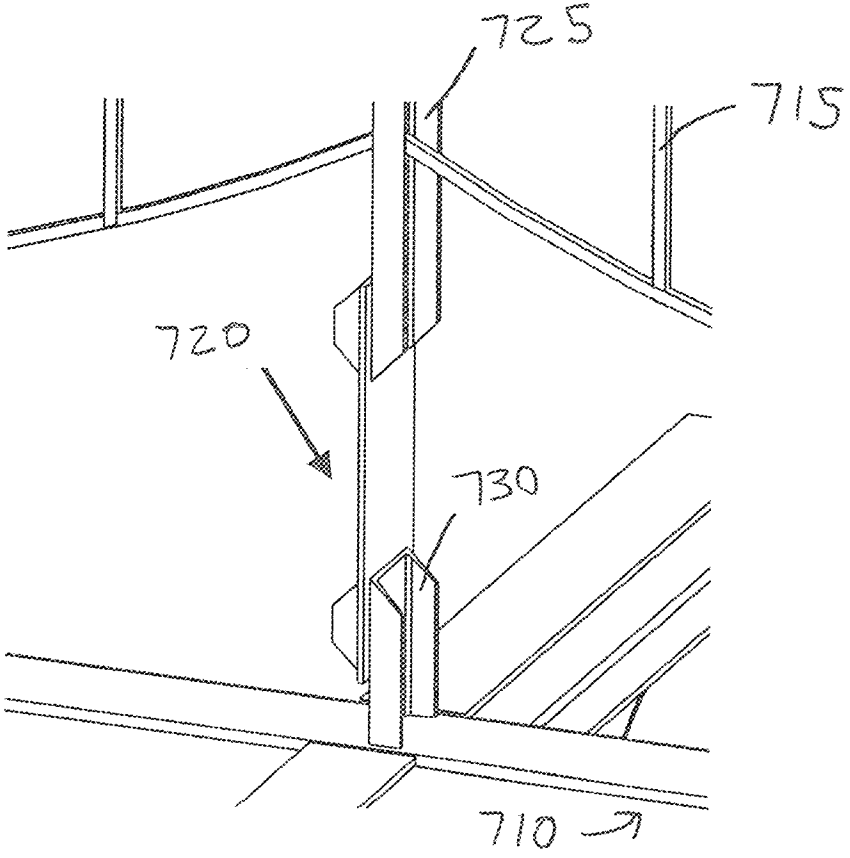
FIG. 8 is a detail view of the compliant net support of FIG. 7A.

FIG. 8 depicts the base of a compliant net support system that employs a leaf spring type compliant member. The leaf spring 720 is rigidly mounted between a lower support 730 and the net. Lower support 730 is firmly connected to the main structural framework 710 (or to a buoyant member) as by welding, bolting, epoxy, etc. The leaf spring 720 is typically made of fiberglass/epoxy bar or a laminate fiberglass mesh coated in an epoxy, such as Gorden Composites™ GC-67-UB available from PolyOne Corporation of Ohio, USA. The leaf spring 720 is primarily unidirectional and orientated along the main axis of the barrier. This orientation provides compliance required for movement due to environmental forces. However, in an impact event, when a vessel impacts the barrier net 715, the spring 720 is stiff and can translate the loads to the main barrier components with minimal deflection.

Figure 9:
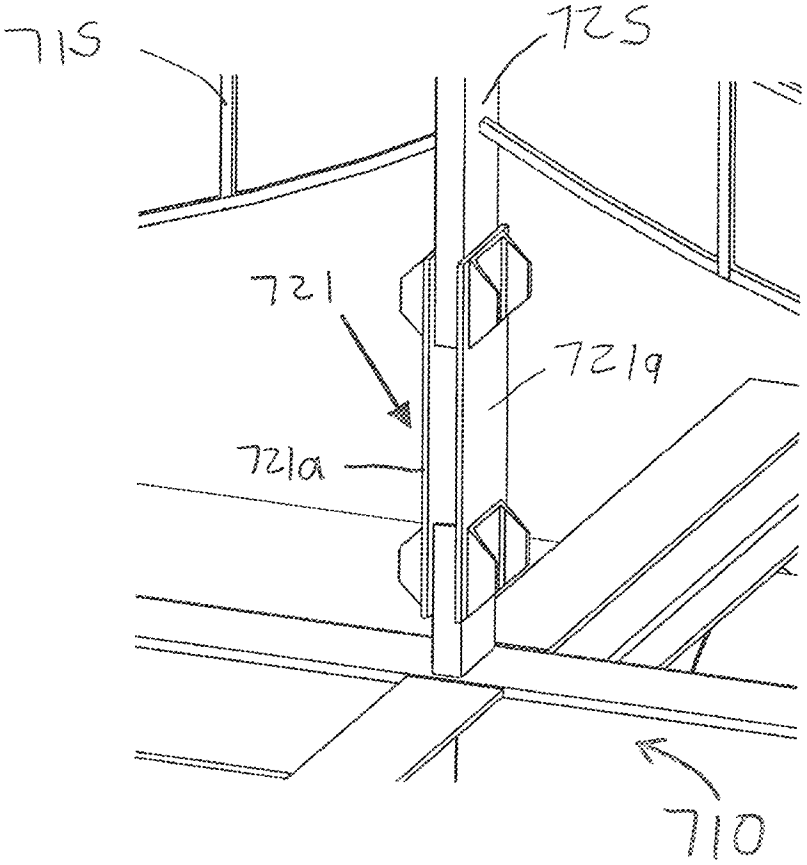
FIG. 9 is a detail view of the compliant net support of FIG. 7B.

In further embodiments, a compliant net support post similar to that of FIG. 8 employs one or more leaf springs to obtain different spring rates for the net compliance, and/or adjust the stress and/or deformation of the net support post. This is schematically illustrated in FIG. 9, where two leaf springs 721*a* are placed parallel to each other to form a spring 721. This provides added rigidity and resistance to deformation in the transverse direction. In addition, the springs 721*a* can be sized to provide a range of spring rates as needed based on the barrier on which the springs are mounted, as well as local environmental forces.

Figure 10:
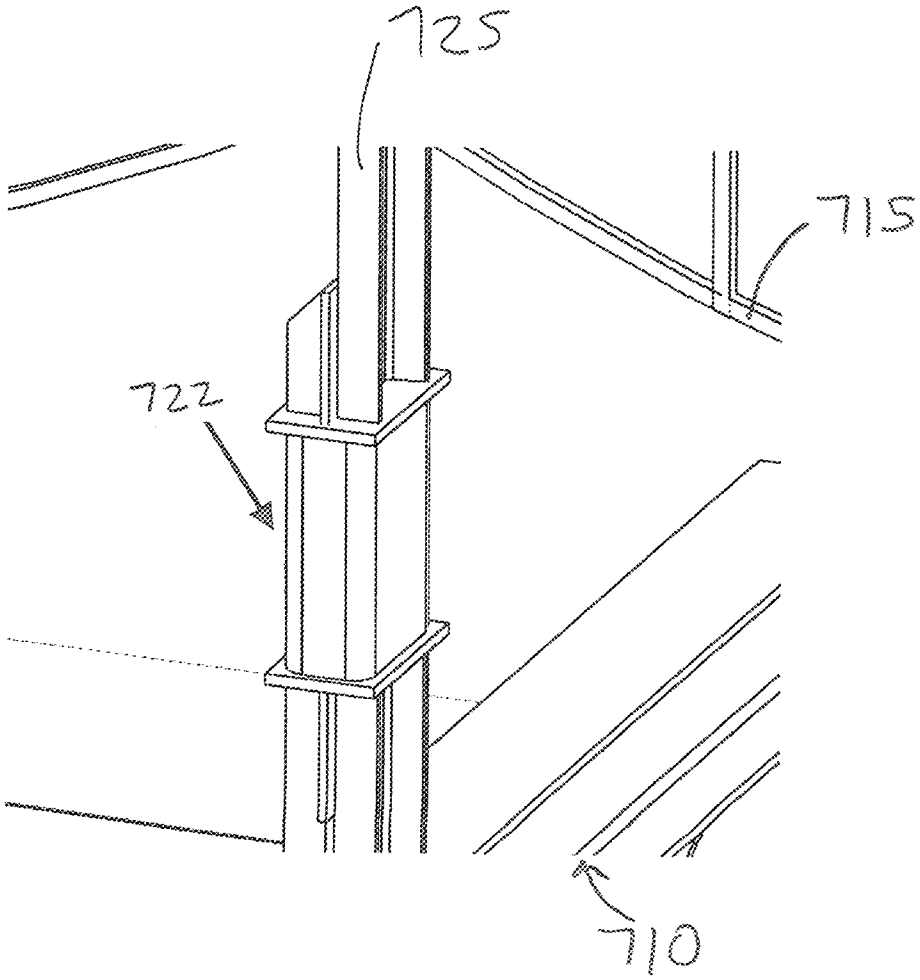
FIG. 10 is a detail view of the compliant net support of FIG. 7C.

Embodiments further include a compliant net support post, similar to that of FIG. 8, which employs one or more rubber mounts 722 instead of a composite/epoxy spring, as seen in FIG. 10. The rubber geometry and stiffness are sized to optimize the directional compliance of the net support post 725, allowing end users to size the system for different environments. The material of mount 722 can be natural or reinforced rubber, such as EPDM rubber with a durometer of 55-70.

Figure 11:
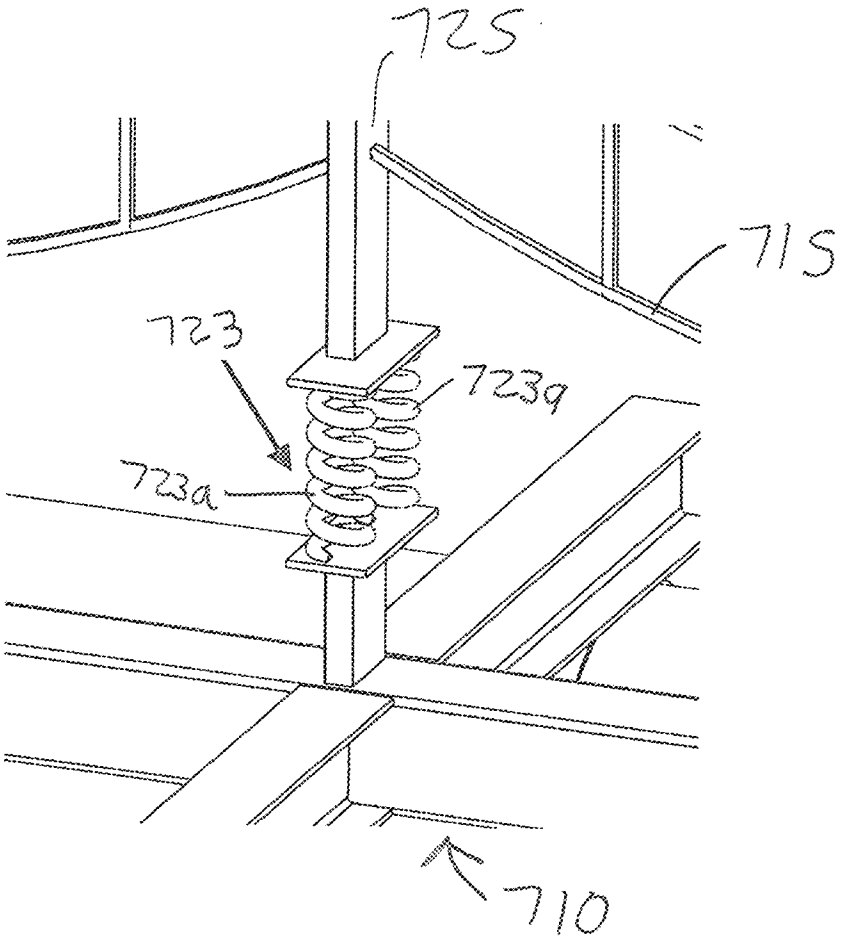
FIG. 11 is a detail view of the compliant net support of FIG. 7D.

Embodiments further include a compliant net support post, similar to that of FIG. 8, that employs one or more coil springs 723*a* to form a spring 723, as shown in FIG. 11. Coil springs 723*a* can be disposed in a variety of orientations and configurations to obtain different spring rates and directional compliance values, depending on the spring orientations. The coil springs are sized and oriented to optimize the directional compliance of the net support post 725, allowing end users to size the system for different environments.

Figure 12A:
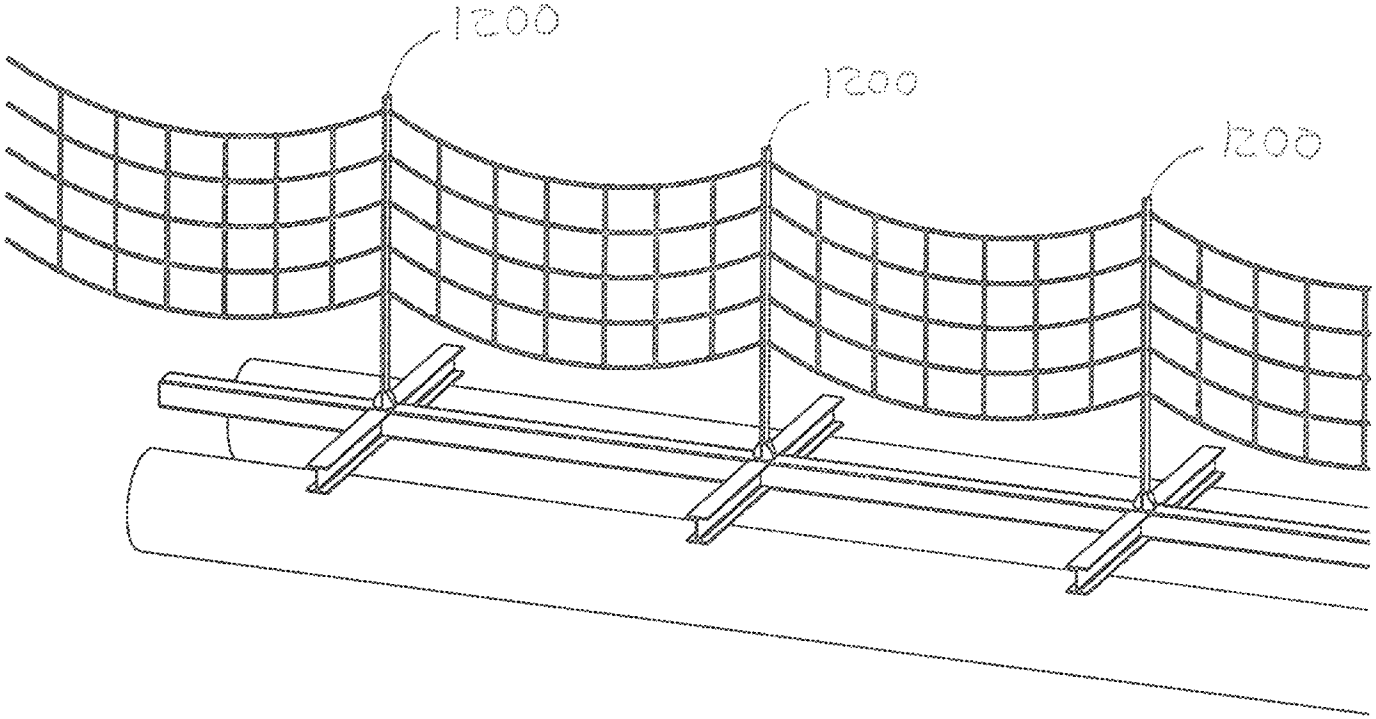
FIGS. 12A-B schematically illustrate a marine barrier system having a compliant net support system according to an embodiment of the present disclosure.
Figure 12B:
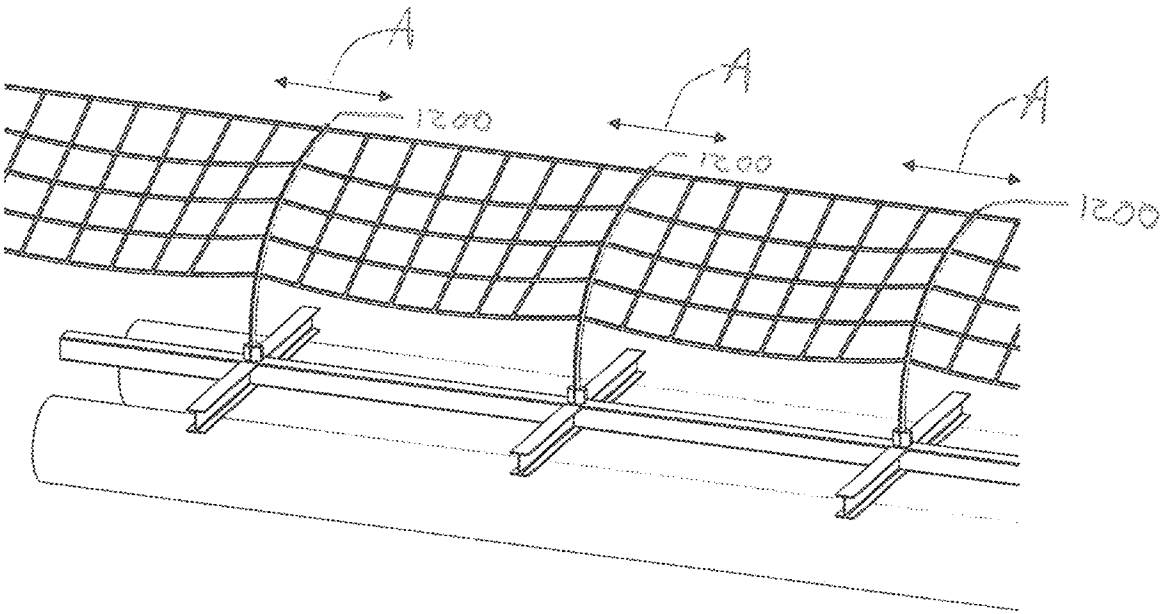

FIGS. 12A-B depict a still further embodiment of the disclosure featuring a "fully compliant" net support system, which employs a composite compliant member substantially throughout its length. The complaint net support member 1200 is spaced and sized to allow for net tension stress relief and will deform, in a uniaxial direction A, when loaded as shown in FIG. 12B. It is important to note that, similar to the other disclosed embodiments, the compliant support system can be applied to any type of marine barrier.

Figure 14B:
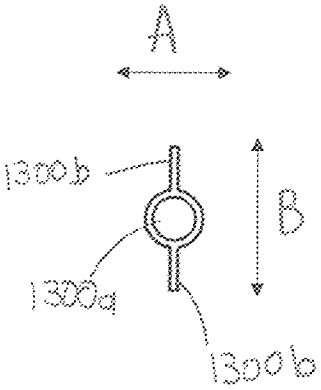
FIGS. 13 and 14A-B are detail views of the compliant net support system of FIGS. 12A-B.
Figure 13:
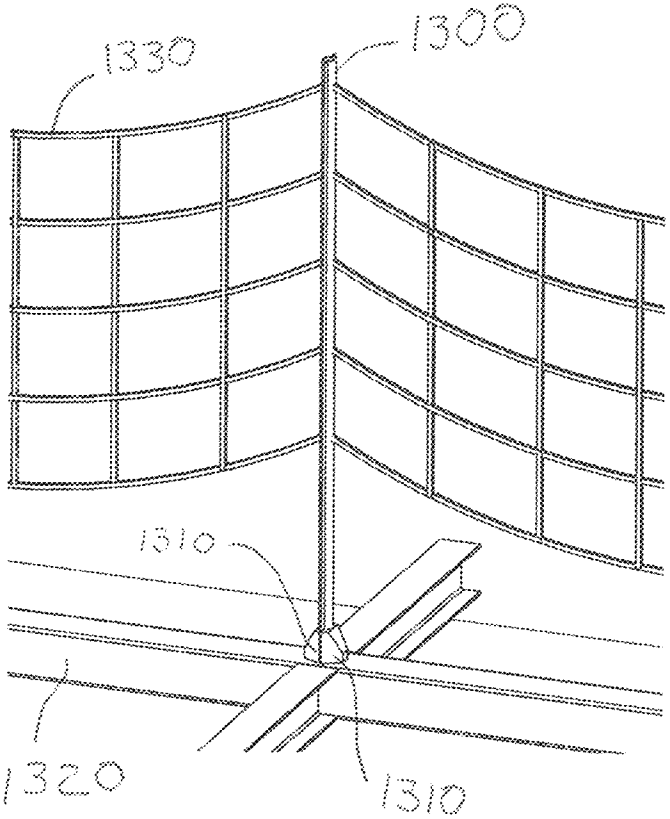
Figure 14A:
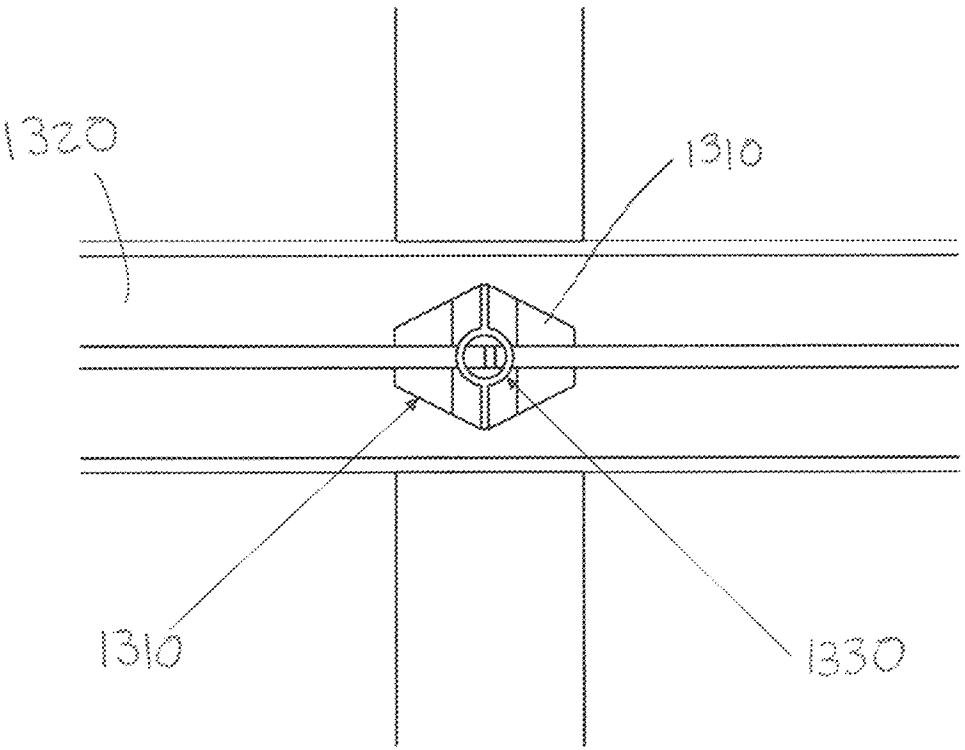
Figure 15:
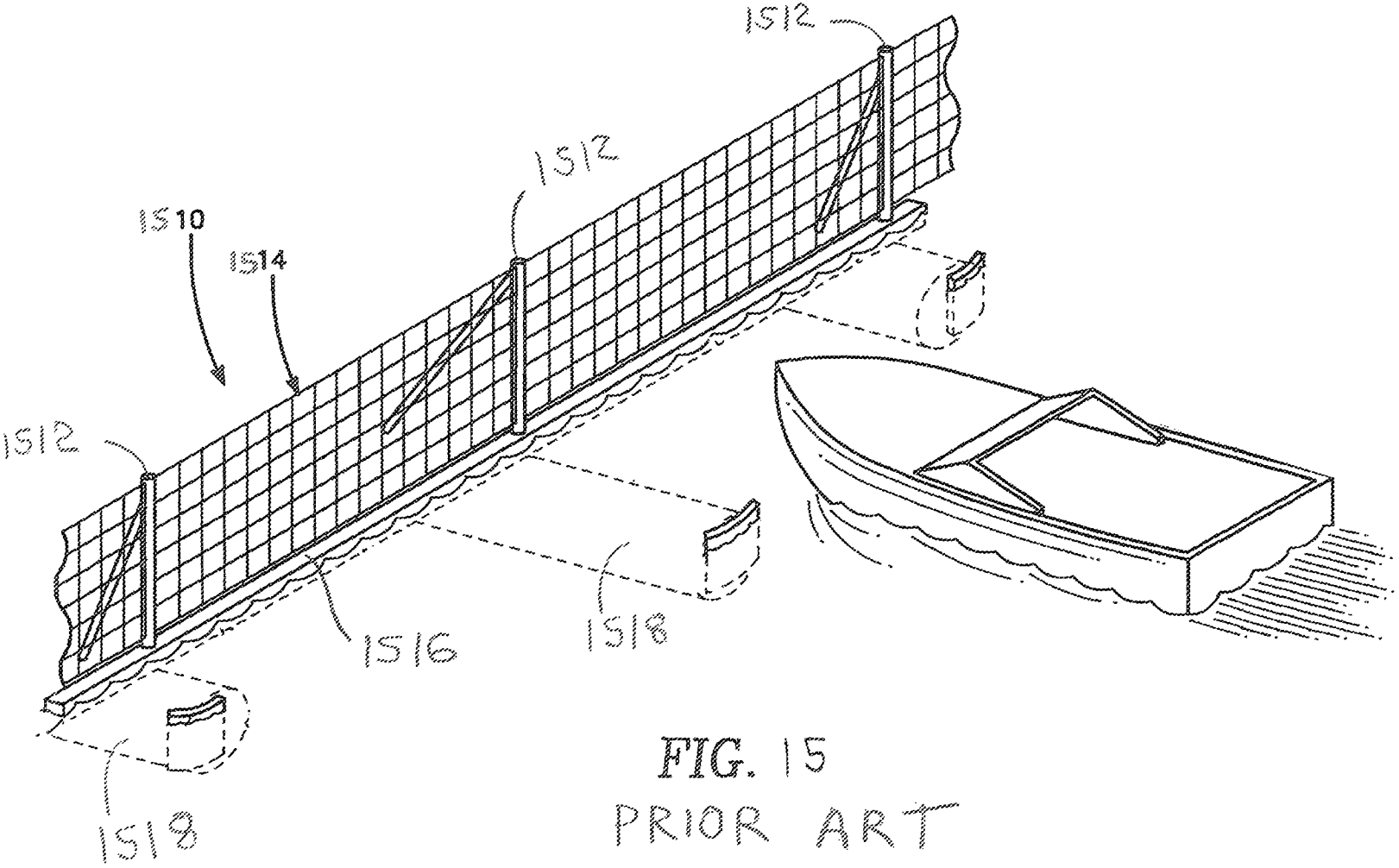
FIG. 15 PRIOR ART
FIG. 15 is a perspective view of a conventional marine barrier.

In the detail views of FIGS. 13 and 14A-B, the compliant net support member is a post 1300 mounted between "bend restrictors" 1310 that mount the system to the barrier framework 1320. The lower support of framework 1320 is firmly connected to the main structural framework or to a buoyant member (not shown) as by welding, bolting, epoxy, etc. The compliant post 1300 is typically made of fiberglass or composite/laminate mesh. The spring geometry is primarily unidirectional and oriented along the main axis A of the barrier. This orientation provides compliance required for movement due to environmental forces. However, in an impact event, when a vessel impacts the barrier net 1330, the post 1300 is stiff and can translate the loads to the main barrier components with minimal deflection.

The geometry of the post 1300 is shown at FIGS. 14A-B. Post 1300 has a hollow cross section 1300*a* to provide flexibility in the direction A substantially parallel to the longitudinal axis of the barrier module, and a stiffener plate 1300*b* to render the support post 1300 substantially inflexible in the direction substantially perpendicular to the longitudinal axis of the barrier module. The post's cross section 1300*a* is shown primarily circular or round with one or more integrated protrusions 1300*b* that provide stiffening in direction B. However, in other embodiments the post's geometry is a non-symmetric cross section (such as a rectangle, oval, etc). In addition, those of skill in the art will understand that a circular cross section can be used with different material properties that provide anisotropic material properties (i.e. stiffer in one axial direction than in an orthononal axial direction).

Those of skill in the art will also understand that the required spring rate for a compliant net support system where the spring is substantially the full length of the net supporting assembly, as in the embodiments of FIGS. 12A-14B, is a function of the length of the net supporting assembly Therefore, unlike the previously-described "discrete" spring lengths, the spring rate shown is present as a moment arm measured from the base of the entire assembly. For these embodiments of the present disclosure, exemplary spring rates and deformation ranges are presented in Table 2 below.

TABLE 2

Exemplary Spring Rates for the Disclosed Compliant Net Support Systems

| Average Spring Rate (N-m/deg) | Typical Deflection (degrees) | Max Deflection (degrees) | Barrier Net Height (m) | Barrier/ Module Spacing (m) | Significant Wave Environments (m) |
|---|---|---|---|---|---|
| 70-170 kN-m | 5-15 deg. | 45 deg. | 0 m-1.2 m | <3 m | 2-3 m |
| 170-1500 kN-m | 5-15 deg. | 45 deg. | 1.21 m-3 m | <5 m | 2-3.5 m |

Similar to the description presented in Table 1, Table 2 provides two ranges of spring rates for the "fully compliant" compliant net system, in units of Newton-meters. The corresponding "Typical Deflection" column values in Table 2 are "normal" deflections the net support system will experience in typical environmental conditions. The corresponding "Max Deflection" column of Table 2 is the designed maximum deformation the compliant net support system can deflect before damage may occur to one or more of the components. The corresponding "Barrier/Module Spacing" column is the distance between compliant net support systems over an area where motion will be resolved (i.e., typically over a barrier module joint). This span is not applicable within the length of a continuous barrier segment that does not need to resolve net forces, such as that shown in FIG. 6A. Rather, it is the spacing of the compliant net support posts wherever they may be needed. Finally, the corresponding "Significant Wave Environments" column is the range of significant wave heights associated with the local site. The size of these waves (and thus fluctuation of the water surface elevation) affects selection of the spring rates detailed in the leftmost column of the table.

While this disclosure has been described in conjunction with a number of embodiments, it is evident that many alternatives, modifications, and variations would be or are apparent to those of ordinary skill in the applicable arts. Accordingly, applicants intend to embrace all such alternatives, modifications, equivalents, and variations that are within the scope and spirit of this disclosure.

What is claimed is:

1. A compliant net support system for supporting a net of a marine barrier, the compliant net support system comprising:

a plurality of substantially rigid columns, each of which is secured to the net and to a frame of the barrier; and a unidirectionally elastic spring element located along a main axis of at least one of the columns and disposed between the column and the barrier frame;

wherein the spring element and respective column is movable in a direction substantially parallel to a longitudinal axis of the barrier, and substantially inflexible in a direction substantially perpendicular to the longitudinal axis of the barrier.

2. The compliant net support system of claim 1, wherein the unidirectionally elastic spring element comprises a leaf spring.

3. The compliant net support system of claim 1, wherein the unidirectionally elastic spring element comprises a plurality of leaf springs disposed substantially parallel to each other.

4. The compliant net support system of claim 1, wherein the unidirectionally elastic spring element comprises rubber.

5. The compliant net support system of claim 1, wherein the unidirectionally elastic spring element comprises one or more coil springs.

6. A floating marine barrier module comprising:

a flotation device;

a supporting framework attached to the flotation device;

a plurality of impact net support posts; and an impact net attached to each of the support posts and extending between the plurality of support posts along a longitudinal axis of the barrier module;

wherein at least one of the impact net support posts is a compliant net support post having a unidirectionally elastic spring element attached between a bottom of the support post and the supporting framework; and wherein the spring element is movable in a direction substantially parallel to the longitudinal axis of the barrier module, and substantially inflexible in a direction substantially perpendicular to the longitudinal axis of the barrier module.

7. A floating marine barrier comprising a plurality of barrier modules according to claim 6, wherein the impact net extends between the plurality of barrier modules along the longitudinal axis of the barrier;

wherein when the barrier is floating in a body of water and a moving vessel impacts the impact net, the impact net deflects to transfer a force of the impact to at least one of the net support posts having the unidirectionally elastic spring element and to one or more of the flotation devices, which in turn engage the water to transfer the force of the impact to the water to arrest the motion of the vessel, while the elastic spring element remains substantially stationary relative to the at least one net support post.

8. The floating marine barrier module of claim 6, comprising a plurality of the flotation devices arranged substantially parallel to each other and joined together by the framework such that the barrier module is substantially rigid along its length.

9. The floating marine barrier of claim 6, wherein one of the compliant net support posts is attached to the framework at each of first and second ends of the barrier module.

10. The floating marine barrier of claim 7, wherein each of the barrier modules comprises a plurality of the flotation devices arranged substantially parallel to each other and joined together by the framework such that the barrier module is substantially rigid along its length; and wherein one of the compliant net support posts is attached to the framework at each of first and second ends of each of the barrier modules.

11. The floating marine barrier of claim 7, wherein the flotation device and framework of each of the barrier modules comprises a plurality of spaced-apart column modules, each having a buoyant central column that carries one the of the impact net support posts;

wherein each column has four legs extending from a lower portion of the column, and each leg is connected to a buoyant float, and adjacent column modules are connected to each other via the floats.

12. The compliant net support system of claim 6, wherein the unidirectionally elastic spring element comprises a leaf spring.

13. The compliant net support system of claim 6, wherein the unidirectionally elastic spring element comprises a plurality of leaf springs disposed substantially parallel to each other.

14. The compliant net support system of claim 6, wherein the unidirectionally elastic spring element comprises rubber.

15. The compliant net support system of claim 6, wherein the unidirectionally elastic spring element comprises one or more coil springs.

16. A floating marine barrier module comprising:

a flotation device;

a supporting framework attached to the flotation device;

a plurality of impact net support posts; and an impact net attached to each of the support posts and extending between the plurality of support posts along a longitudinal axis of the barrier module;

wherein at least one of the impact net support posts is a compliant net support post which is flexible along substantially its entire length and attached to the supporting framework; and wherein the compliant net support post is flexible in a direction substantially parallel to the longitudinal axis of the barrier module, and substantially inflexible in a direction substantially perpendicular to the longitudinal axis of the barrier module.

17. A floating marine barrier comprising a plurality of barrier modules according to claim 16, wherein the impact net extends between the plurality of barrier modules along the longitudinal axis of the barrier;

wherein when the barrier is floating in a body of water and a moving vessel impacts the impact net, the impact net deflects to transfer a force of the impact to at least one of the compliant net support posts and to one or more of the flotation devices, which in turn engage the water to transfer the force of the impact to the water to arrest the motion of the vessel, while the compliant net support post remains substantially stationary relative to the framework.

18. The floating marine barrier module of claim 16, comprising a plurality of the flotation devices arranged substantially parallel to each other and joined together by the framework such that the barrier module is substantially rigid along its length.

19. The floating marine barrier of claim 17, wherein one of the compliant net support posts is attached to the framework at each of first and second ends of the barrier module.

20. The floating marine barrier module of claim 16, wherein the compliant net support post comprises a composite material and has a hollow cross section to provide flexibility in the direction substantially parallel to the longitudinal axis of the barrier module, and a stiffener plate to render the support post substantially inflexible in the direction substantially perpendicular to the longitudinal axis of the barrier module.

* * * * *